343-700 MS AU 251 EX
5/20/86 CF 4,590,478

United States Patent [19]

Powers et al.

[11] Patent Number: 4,590,478

[45] Date of Patent: May 20, 1986

[54] MULTIPLE RIDGE ANTENNA

[75] Inventors: Richard L. Powers; Kenneth D. Arkind; Richmond W. Price, all of Nashua, N.H.

[73] Assignee: Sanders Associates, Inc., Nashua, N.H.

[21] Appl. No.: 504,566

[22] Filed: Jun. 15, 1983

[51] Int. Cl.[4] ..... H01Q 1/38

[52] U.S. Cl. ..... 343/700 MS; 343/770

[58] Field of Search ..... 343/767–771, 343/700 MS, 705, 708, 789, 824, 829, 830, 846

[56] References Cited

U.S. PATENT DOCUMENTS

| | | | |
|---|---|---|---|
| 3,031,665 | 4/1962 | Marié | 343/770 |
| 3,348,227 | 10/1967 | Rolfs | 343/768 |
| 3,653,052 | 3/1972 | Campbell et al. | 343/708 |
| 3,665,480 | 5/1972 | Fassett | 343/700 MS |
| 3,680,142 | 7/1972 | van Atta et al. | 343/770 |
| 4,017,864 | 4/1977 | Proctor | 343/767 |
| 4,072,951 | 2/1978 | Kaloi | 343/846 |
| 4,130,822 | 12/1978 | Conroy | 343/700 MS |
| 4,197,544 | 4/1980 | Kaloi | 343/700 MS |
| 4,197,545 | 4/1980 | Favaloro et al. | 343/767 |
| 4,371,877 | 2/1983 | Doussot et al. | 343/770 |
| 4,426,649 | 1/1984 | Dubost et al. | 343/813 |
| 4,443,802 | 4/1984 | Mayes | 343/770 |
| 4,464,663 | 8/1984 | Lalezari et al. | 343/846 |

OTHER PUBLICATIONS

Johnson et al, "Antenna Engineering Handbook" Ch. 7, Microstrip Antennas pp. 7-1 to 7-18, Published by McGraw-Hill, New York, 1984.

Greiser, "Coplanar Stripline Antenna", Microwave Journal, Oct. 1976, pp. 47–49.

*Primary Examiner*—Eli Lieberman
*Assistant Examiner*—Michael C. Wimer
*Attorney, Agent, or Firm*—Louis Etlinger; Stanton D. Weinstein

[57] ABSTRACT

A microwave antenna (10) is excited by two independently driven feed lines (30 and 32) so that the plane of polarization of the resultant microwave radiation depends on the relative amplitudes of the signals on the two feed lines. The feed lines are disposed between two parallel ground planes (12 and 14), in one of which is etched an aperture (18). The periphery of the aperture forms ridges (20, 22, 24, and 26) in registration with the feed lines (30 and 32). Conductive eyelets (27) extend between the ground-plane conductors (12 and 14) to act as shorting elements that surround the aperture to form a cavity defined by the shorting elements and the ground-plane conductors. The resultant antenna, which may, for instance, have a thickness of only one-tenth of a wavelength, achieves a 2:1 VSWR bandwidth on the order of 30%.

27 Claims, 2 Drawing Figures

MULTIPLE RIDGE ANTENNA

BACKGROUND OF THE INVENTION

The present invention is directed to microwave antennas and finds particular application in printed-circuit or other thin microwave antennas of the type that can be made to conform to the surface of an aircraft.

In place of conventional waveguides, thin devices, commonly referred to as stripline or microstrip devices, have been used, for some time, to conduct microwave signals, and antennas have been fabricated employing this technology. The small size and low weight of such devices make them attractive for aircraft applications. Additionally, since antennas employing this technology can be made to be very thin in one dimension, they can easily be made to conform to the surfaces of aircraft.

However, these thin antennas tend to have considerably narrower bandwidths than do the more conventional waveguide types.

An antenna configuration that significantly reduces this drawback is disclosed in U.S. Pat. No. 4,197,545 to Favaloro et al. In that arrangement, shorting elements extending between ground planes of a stripline structure define a cavity, and one of the ground planes provides a slot opening into the cavity. The feed for this antenna is provided by a T-shaped conductor extending into the cavity and connected to the ground plane at the ends of the crosspiece of the T. It has been found that this type of antenna has a bandwidth that is significantly wider than those possible with previous stripline or microstrip antennas.

SUMMARY OF THE INVENTION

An object of the present invention is another antenna configuration that achieves a bandwidth wider than was possible before the advent of the Favaloro et al. arrangement and that additionally lends itself to use in a variable-polarization operation with a symmetrical radiation pattern.

We have found that a broad bandwidth can be achieved in a stripline antenna in which at least a pair of ridges is formed in the periphery of an aperture formed in one of the ground planes. The ridges extend toward each other from opposite sides of the aperture but leave a gap between their ends. A feed line extends between and parallel to the ground planes in registration with the ridges and extends across the gap between them. We have found that this type of antenna results in a broader bandwidth than can be obtained with pre-Favaloro microstrip and stripline antennas.

Furthermore, this principle can be employed in a variable-polarization antenna having a desirably symmetrical radiation pattern if two pairs of ridges are provided, one pair being oriented perpendicular to the other pair, and separate feed lines are disposed in registration with corresponding pairs of ridges. The feed lines can be excited separately and their relative amplitudes varied so as to vary the plane of polarization of the radiation generated by the resulting antenna.

The invention is defined more particularly in the claims that follow.

BRIEF DESCRIPTION OF THE DRAWINGS

These and further features and advantages of the present invention are described by reference to the accompanying drawings, in which.

DETAILED DESCRIPTION OF THE PREFERRED EMBODIMENT

Figure 1:
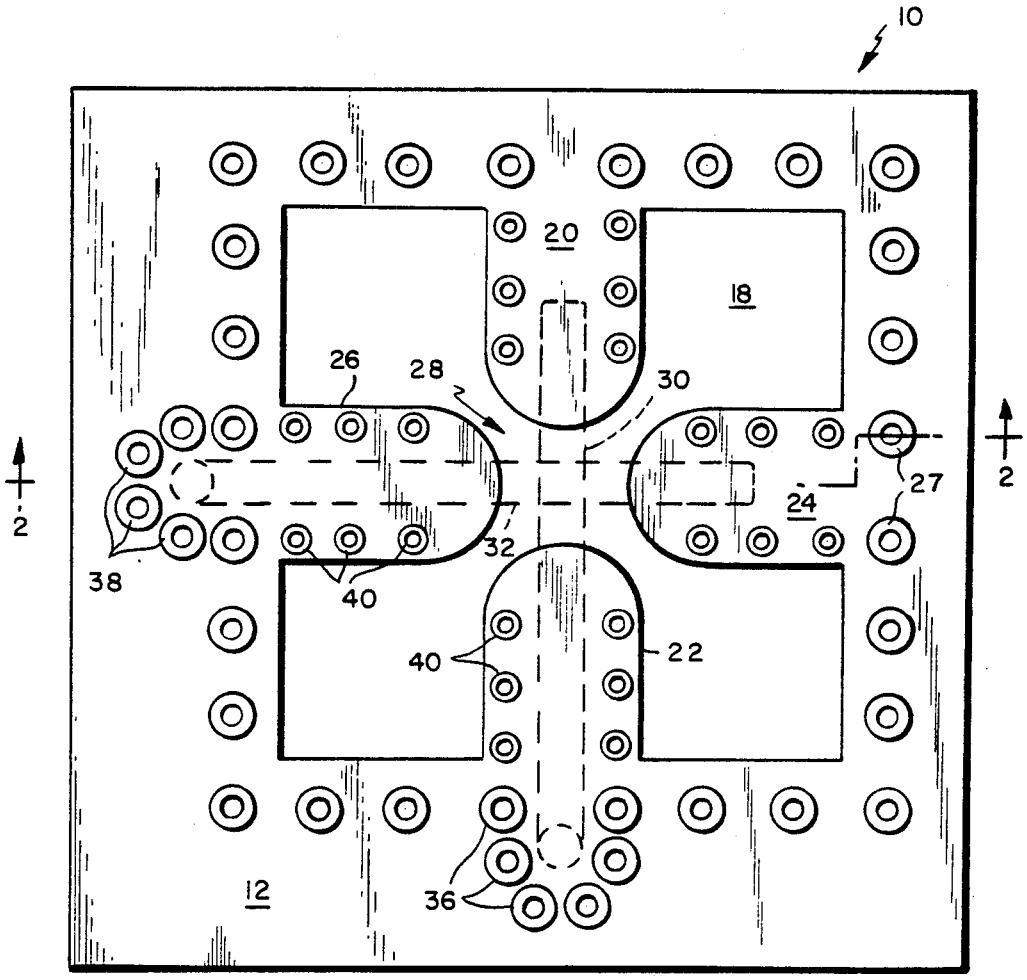
FIG. 1 is a plan view of one embodiment of the present invention.
Figure 2:
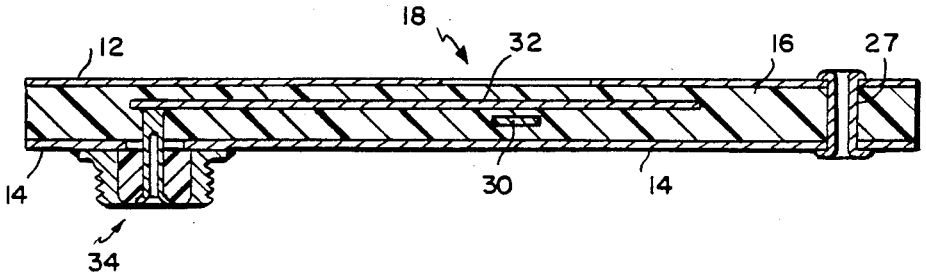
FIG. 2 is a sectional view of the antenna of FIG. 1 taken at line 2—2 of FIG. 1.

FIGS. 1 and 2 depict an antenna 10 for transmission and reception of radiation within a predetermined band of microwave frequencies. The antenna includes upper and lower, generally planar ground-plane conductors 12 and 14 that extend generally parallel to each other. Conductors 12 and 14 are spaced from each other by approximately one-tenth of a wavelength at a frequency in the middle of the predetermined frequency band for which the antenna is designed. This spacing is not critical, but it should be less than a quarter wavelength at any frequency in the band. Between the ground planes 12 and 14 is a dielectric layer 16, and, unless otherwise described, distances mentioned herein are given in wavelengths at the center frequency as measured in the dielectric. Fiberglass-reinforced polytetrafluoroethylene is commonly used as the dielectric, but the dielectric material is not critical.

The upper ground plane 12 is etched to form a generally square aperture 18 whose periphery defines four elongated ridges 20, 22, 24, and 26 extending inward from, and perpendicularly to, the edges of the aperture 18. The two pairs of ridges provide a gap 28 between their opposed ends.

A multiplicity of conductive eyelets 27 interconnect the ground-plane conductors 12 and 14. The eyelets surround the aperture 18, defining a cavity with the ground-plane conductors 12 and 14. The cavity should be between one-half and one wavelength at frequencies in the intended range. In the illustrated example, the cavity is generally square, being approximately three-quarters of a wavelength on a side. The aperture 18, which also is generally square, is slightly smaller than the cavity, being 0.69 wavelength on a side in the illustrated embodiment. The ridges 20, 22, 24, and 26 are 0.25 wavelength long and 0.18 wavelength wide.

Microwave energy is fed into the cavity by means of two independently driven feed circuits that include a pair of mutually perpendicular feed-line conductors 30 and 32 that are slightly vertically spaced from each other and are disposed between the ground planes 12 and 14. Conductor 30 extends generally in the direction of ridges 20 and 22 and is in registration with them. Similarly, conductor 32 extends generally in the direction of ridges 24 and 26 and is in registration with them. Both conductors 30 and 32 extend across the gap 28 between the ridges.

Signals to be transmitted or received by the antenna 10 are conveyed in the illustrated embodiment by a pair of coaxial lines whose center conductors are connected to the outer ends of the feed-line conductors 30 and 32. A coaxial connector 34 for connecting a coaxial line to conductor 32 can be seen in FIG. 2. A similar connector (not shown) is provided for conductor 30. Eyelets 36 and 38 connect the two ground-plane conductors 12 and 14 together in a semicircular configuration around the coaxial connectors, and further eyelets 40 connect the ground planes together alone the longitudinal edges of the ridges 20, 22, 24, and 26.

In operation, microwave signals propagate along one or the other or both of the microstrip feed lines 30 and 32. If a plane of polarization parallel to feed-line conductor 30 is desired, the signal is restricted to feed line 30. If the plane of polarization is to be parallel to feed line 32, feed line 32 alone is driven. Planes of polarization between the two extremes are achieved by driving both feed lines simultaneously, the angle of the polarization plane being the inverse tangent of the ratio of the signal amplitudes on the two feed lines.

We have found that an antenna of the type described above provides the size and weight advantages exhibited by microstrip or stripline antennas but has a considerably greater bandwidth. Specifically, 2:1 VSWR bandwidths on the order of 30% of the center frequency have been achieved with this type of antenna.

Although the invention has been described by reference to a specific embodiment, its teachings extend to many variations that fall within the scope of one or more of the claims below.

What is claimed is:

1. A variable-polarization microwave antenna for sending and receiving microwaves at frequencies within a predetermined frequency range, the antenna comprising:

A. first and second generally planar ground-plane conductors spaced apart and extending substantially parallel to each other, said first ground-plane conductor having an aperture therethrough and including first and second pairs of elongated ridges extending into said aperture and oriented perpendicular to each other, the ridges of each pair extending toward each other from opposite sides of said aperture and leaving a gap therebetween;

B. shorting elements extending between said ground-plane conductors and surrounding said aperture to form a cavity defined by said shorting elements and said ground-plane conductors, the distances across said cavity in the directions of said ridges being between one-half and one wavelength at frequencies within the predetermined frequency range;

C. a first feed line including a first elongated feed conductor extending between and generally parallel to said ground-plane conductors and into said cavity substantially in registration with the ridges of said first pair and across the gap therebetween; and D. a second feed line including a second elongated feed conductor extending between and generally parallel to said ground-plane conductors and into said cavity substantially in registration with the ridges of said second pair and across the gap therebetween, said first and second feed conductors being electrically isolated from each other.

2. A microwave antenna as recited in claim 1 further including shorting elements extending between said ground-plane conductors along the longitudinal edges of said ridges.

3. A microwave antenna as recited in claim 2 wherein said cavity has a substantially square periphery defined by said shorting elements, and each of said ridges is substantially equidistant from opposite sides of the cavity periphery.

4. A microwave antenna as recited in claim 1 wherein said ground-plane conductors are spaced apart by less than one-fourth wavelength at frequencies within the predetermined frequency range.

5. A microwave antenna as recited in claim 4 further including shorting elements extending between said ground-plane conductors along the longitudinal edges of said ridges.

6. A microwave antenna as recited in claim 5 wherein said cavity has a substantially square periphery defined by said shorting elements, and each of said ridges is substantially equidistant from opposite sides of the cavity periphery.

7. A microwave antenna as recited in claim 1 wherein said cavity has a substantially square periphery defined by said shorting elements, and each of said ridges is substantially equidistant from opposite sides of the cavity periphery.

8. A microwave antenna as recited in claim 1 wherein said ground-plane conductors are spaced apart by substantially one-tenth wavelength at a frequency within the predetermined frequency range.

9. A microwave antenna as recited in claim 1 wherein:

said first feed conductor lies between said second ground-plane conductor and both ridges of said first pair; and said second feed conductor lies between said second ground-plane conductor and both ridges of said second pair.

10. A microwave antenna as recited in claim 1 further including:

a first connector connected to said first feed conductor; and a second connector connected to said second feed conductor.

11. A microwave antenna as recited in claim 10 further including shorting elements extending between said ground-plane conductors about said connectors other than on said ridges.

12. A microwave antenna for sending and receiving microwaves at frequencies within a predetermined frequency range, the antenna comprising:

A. first and second generally planar ground-plane conductors spaced apart and extending substantially parallel to each other, said first ground-plane conductor having an aperture therethrough and including a pair of elongated ridges extending into said aperture, each ridge having a round end, said ridges extending toward each other from opposite sides of said aperture and leaving a gap therebetween;

B. shorting elements extending between said ground-plane conductors and surrounding said aperture to form a cavity defined by said shorting elements and said ground-plane conductors; and C. a feed line including an elongated feed conductor extending between and generally parallel to said ground-plane conductors and into said cavity substantially in registration with said ridges and across said gap therebetween.

13. A microwave antenna as recited in claim 12 wherein said ground-plane conductors are spaced apart by less than one-quarter wavelength at frequencies within the predetermined frequency range.

14. A microwave antenna as recited in claim 13 further including shorting elements extending between said ground-plane conductors along the longitudinal edges of said ridges.

15. A microwave antenna as recited in claim 12 wherein said ground-plane conductors are spaced apart by substantially one-tenth wavelength at a frequency within the predetermined frequency range.

16. A microwave antenna as recited in claim 8 wherein said feed conductor lies between said second ground-plane conductor and both of said pair of ridges.

17. A microwave antenna as recited in claim 8 wherein said feed conductor comprises a stripline feed conductor.

18. A microwave antenna as recited in claim 12 further including a connector connected to said feed conductor.

19. A microwave antenna as recited in claim 18 further including shorting elements extending between said ground-plane conductors about said connector other than on said ridges.

20. A microwave antenna as recited in claim 12 wherein said round end is substantially semi-circular in shape.

21. A microwave antenna as recited in claim 12 wherein each of said ridges is substantially 0.25 wavelength long and substantially 0.18 wavelength wide at a frequency within the predetermined frequency range.

22. A microwave antenna as recited in claim 12 wherein the distance across said cavity in the direction of said ridges is between one-half and one wavelength at frequencies within the predetermined frequency range.

23. A microwave antenna for sending and receiving microwaves at frequencies within a predetermined frequency range, the antenna comprising:

A. first and second generally planar ground-plane conductors spaced apart and extending substantially parallel to each other, said first ground-plane conductor having an aperture therethrough and including a pair of elongated ridges extending into said aperture, said ridges extending toward each other from opposite sides of said aperture and leaving a gap therebetween;

B. shorting elements extending between said ground-plane conductors and surrounding said aperture to form a cavity defined by said shorting elements and said ground-plane conductors, the distance across said cavity in the direction of said ridges being between one-half and one wavelength at frequencies within the predetermined frequency range;

C. a feed line including an elongated feed conductor extending between and generally parallel to said ground-plane conductors and into said cavity substantially in registration with said ridges and across said gap therebetween; and D. shorting elements extending between said ground-plane conductors along the longitudinal edges of said ridges.

24. A microwave antenna as recited in claim 23 wherein said ground-plane conductors are spaced apart by less than one-fourth wavelength at frequencies within the predetermined frequency range.

25. An antenna, comprising:

first and second generally planar ground-plane conductors spaced apart and extending substantially parallel to each other, said first ground-plane conductor having an aperture therethrough and including a pair of elongated ridges extending into said aperture, said ridges extending toward each other from opposite sides of said aperture and leaving a gap therebetween;

a feed line extending between and generally parallel to said ground-plane conductors substantially in registration with said ridges and across said gap therebetween; and shorting elements extending between said ground-plane conductors along the longitudinal edges of said ridges.

26. An antenna, comprising:

first and second generally planar ground-plane conductors spaced apart and extending substantially parallel to each other, said first ground-plane conductor having an aperture therethrough and including a plurality of pairs of elongated ridges extending into said aperture, the ridges of each pair extending toward each other from opposite sides of said aperture and leaving a gap therebetween;

shorting elements extending between said ground-plane conductors and surrounding said aperture to form a cavity defined by said shorting elements and said ground-plane conductors; and a like plurality of feed lines, each feed line including an elongated feed conductor extending between and generally parallel to said ground-plane conductors and into said cavity substantially in registration with the ridges of a pair and across the gap therebetween.

27. An antenna as recited in claim 26 further including shorting elements extending between said ground-plane conductors along the longitudinal edges of said ridges.

* * * * *